United States Patent [19]

Davidson

[11] 4,385,580

[45] May 31, 1983

[54] MARINE DOOR UNIT

[75] Inventor: Samuel L. Davidson, Winnsboro, La.

[73] Assignee: Mastercrafters Corporation, Winnsboro, La.

[21] Appl. No.: 243,088

[22] Filed: Mar. 12, 1981

Related U.S. Application Data

[63] Continuation of Ser. No. 27,792, Apr. 6, 1979, abandoned.

[51] Int. Cl.[3] ..... B63B 19/12

[52] U.S. Cl. ..... 114/201 R; 49/476

[58] Field of Search ..... 114/116, 117, 173–176, 114/178, 201 R, 201 A, 203, 343, 364; 9/1.1, 1.7; 49/381, 408, 400, 401, 471, 476, 485; 296/213

[56] References Cited

U.S. PATENT DOCUMENTS

| | | | |
|---|---|---|---|
| 2,421,400 | 6/1947 | Young | 49/485 |
| 3,183,873 | 5/1965 | Hamilton | 114/201 R |
| 3,927,493 | 12/1975 | Tsuneishi et al. | 49/476 |
| 3,972,558 | 8/1976 | Horn | 296/213 |

FOREIGN PATENT DOCUMENTS

| | | | |
|---|---|---|---|
| 341858 | 1/1931 | United Kingdom | 114/201 R |
| 698798 | 10/1953 | United Kingdom | 114/201 R |

*Primary Examiner*—Trygve M. Blix
*Assistant Examiner*—Jesús D. Sotelo
*Attorney, Agent, or Firm*—Donald A. Kaul

[57] ABSTRACT

A marine door unit consists of a rigid frame adapted to be attached to a deck and a door hingably connected to the frame. The frame is a rigid metallic unit formed of channel members, at least one of which carries a drain tube to prevent water accumulation therein. The frame means includes an inner upstanding support rail which carries a continuous sealing gasket. When the door is closed, the inner surface thereof abuts against the support rail, compressing the sealing gasket and rendering the door unit substantially leak-proof. In the event of any water leakage past the edges of the door, such leakage collects in the channel and discharges through the drain tube. The door unit is particularly useful on boats of the type having a fishing platform with a storage compartment beneath the platform. On such boats, the door unit is mounted in an opening in the platform and serves to keep the compartment dry while remaining substantially flush with the platform surface.

3 Claims, 7 Drawing Figures

MARINE DOOR UNIT

This is a continuation, of application Ser. No. 27,792, filed Apr. 6, 1979, now abandoned.

This invention relates to an improved form of door unit and more particularly it relates to an improved door unit adapted and intended for use on boats of the type having a fishing platform with a storage compartment beneath the platform. The present invention is thus referred to as a marine door unit.

It is customary to provide access doors on marine vessels such as pleasure boats and fishing boats in order to cover storage areas or other compartments where gear and equipment is stowed. The purpose for such doors is twofold; namely, to cover and thereby protect items which are stored in the hold and to provide a continuous deck surface to enable occupants of the boat to walk across or stand upon the same.

In the past, problems have arisen with respect to such door units and these problems have caused dissatisfaction among boat owners. Moreover, prior attempts to solve these problems have not proved altogether satisfactory. In one prior approach, the door opening was surrounded by an upstanding lip and rested upon the deck surface. While this approach did prevent water leakage into the compartment underlying the deck, it also resulted in the door being raised above the level of the remainder of the deck. This made it difficult to use the deck for a fishing platform. Another prior approach provided a depending shoulder about the periphery of the opening, the shoulder having an inwardly directed flange against which the door abutted when closed. While this approach permitted the door to be flush with the deck, it did not prevent water from leaking around the edges of the door and into the compartment beneath the deck. In still another prior approach, the deck inverted channels and the doors were provided with depending shoulders which abutted against the deck surface. These doors were enlarged in size so that their tops provided surface to be stood upon and used as a fishing platform. This approach likewise proved unsatisfactory, in part because the larger size of the doors gave them less strength as a support surface and in part because there was still water leakage into the underlying compartment.

In general, therefore, prior efforts at providing marine door units proved less than satisfactory and proved to be a continuing source of irritation for boat owners. The prevailing design criteria merely called for a door which was reasonably attractive and would serve to hide the underlying storage compartment, but scant attention was given to the questions of structural integrity, proper fit and proper sealing for such door units.

With the foregoing in mind, it is, therefore, an object of the present invention to provide a new and improved form of marine door unit which overcomes the difficulties and deficiencies associated with known types of such units.

Another object of the present invention is to provide an improved form of marine door unit which seals tightly and which prevents water leakage into the hold or storage area to which the door provides access.

Another object of the present invention is to provide a marine door unit which can be easily installed and which can be used for extended periods of time, yet still retain its structural integrity and its sealing ability.

Another object of the present invention is to provide a satisfactory boat construction for a boat of the type having a fishing platform with an underlying compartment closed by an access door, wherein the door, when closed, is substantially flush with the platform surface and wherein water is prevented from leaking into the underlying compartment.

Other objects, advantages and salient features of the present invention will become apparent from the following detailed description, which, taken into conjunction with the annexed drawings, discloses a preferred embodiment thereof.

Referring to the drawings which form a part of this original disclosure:

Figure 1:
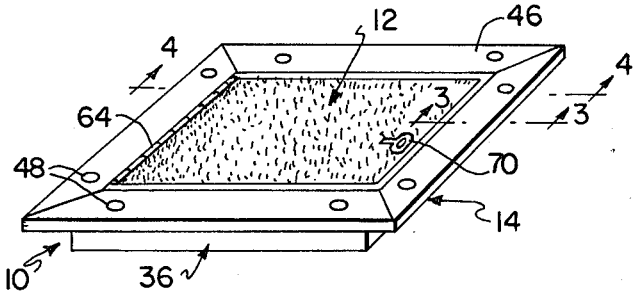
FIG. 1 is a perspective view of a marine door unit in accordance with the principles of the present invention, the door being shown in closed position.

The foregoing objects are attained by providing, in combination, an improved form of door means connected with an improved form of frame means. The door means consists of a shaped metallic plate having an inner and outer surface. The outer surface is covered by a suitable surface covering, such as carpeting, and side molding means are provided along the edges of the door means to clamp the surface covering firmly to the plate member. The door means is attached, advantageously by a continuous hinge member, to the frame means. The frame means itself consists of four interconnected side frame members, advantageously formed of rigid metallic material, which members serve to circumscribe and define the door opening which is covered by the door means in its closed position. Each of the frame members includes a channel means defined by spaced parallel inner and outer leg members connected at their lower edges by a base member. The height of the outer leg member exceeds that of the inner leg member and an outwardly directed flange projects from the upper edge of the outer leg to abut against the deck surface of the marine vessel on which the door unit is mounted. A shoulder extends inwardly from the upper edge of the inner leg member and an upstanding support rail means is mounted upon the shoulder. A continuous sealing gasket fits into the top of the support rail means and a drain aperture and drain tube is provided along at least one of the base members of the frame. When the door is swung to a closed position, the inner surface of the door plate member abuts against, compresses slightly and hence seals upon the continuous sealing gasket. This prevents water leakage past the door and into the hold or storage area covered by the door unit. In the event that any water should leak around the edges of the door means, such water collects in the channel and discharges through the drain aperture and drain tube. The door means is advantageously mounted in an opening in a fishing platform on a boat, to provide access to a compartment beneath the platform while assuring that such compartment remains dry.

Referring now to the drawings in further detail, the marine door unit which is generally designated 10 includes a door means generally designated 12 and a frame means generally designated 14. The door means 12 includes a metallic plate member 16 having an inner surface 18 and an outer surface 20. A layer of surface covering 22 is provided across the outer surface 20 of the plate member 16 and advantageously is formed of carpeting or other suitable deck material.

Figure 3:
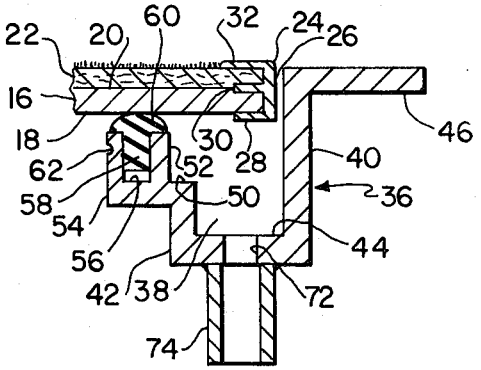
FIG. 3 is a fragmentary sectional view taken along the line 3—3 of FIG. 1.

The door means further includes side molding means 24 attached along at least three edges of the door means to keep the surface covering 22 engaged with the plate member 16. As best illustrated in FIG. 3, the molding means 24 is generally reverse E-shaped in cross-sectional configuration to clamp against the edges of both the plate member 16 and the surface covering 22. Specifically, the molding means 24 includes an outer leg 26 having spaced parallel legs extending perpendicularly inward therefrom. These legs are designated as an inner leg 28, an intermediate leg 30 and an outer leg 32. The space between the legs 28 and 30 forms a first groove which receives the edge of the door plate member 16 and clamps thereagainst. Similarly, the space between the legs 30 and 32 forms another continuous groove which receives the edge of the surface covering 22 and clamps against it. As a result, the molding means 24 not only functions as an edge trim for the door unit, but also functions to retain the surface covering 22 tightly against the underlying door plate member 16.

Figure 2:
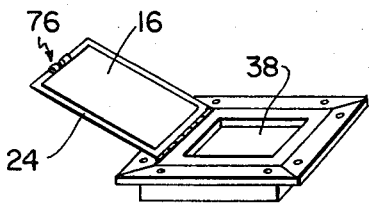
FIG. 2 is a perspective view similar to FIG. 1, but showing the door in open position.

The frame means 14 of the present inventions is formed of four permanently interconnected metallic side frame members, advantageously formed of heavy extruded aluminum, with such side frame members being generally designated 36. The four side frame members, when interconnected as illustrated, serve to circumscribe and define the door opening 38. This door opening provides access to the hold or storage area when the door is open, as illustrated in FIG. 2, but is closed by the door means 12 when such door means is in its closed position, as illustrated in FIG. 1. In the illustrated embodiment of the invention, both the frame means 14 and the door means 12 are square, and accordingly, the door opening 38 is likewise square and is of a size to receive and accommodate the door means 12 in a manner to be presently described.

Each of the frame members 36 includes a channel or channel means 38. This channel 38 is defined by an outer leg member 40, an inner leg member 42 and a base member 44 which extends between and connects the inner and outer leg members at their lower edges. It will be noted that the inner and outer leg members 40 and 42 are disposed in parallel relation to each other, spaced apart by the width of the base member 44. It will further be noted that the height of the outer leg member 40, as measured above the base member 44, is considerably greater than the height of the inner leg member 42 as measured above the base member 44.

At its upper edge, the outer leg member connects with and thus carries an outwardly directed flange 46. The size of the frame means 14 is obviously predetermined by the size of the deck opening into which the door unit is to fit. Ordinarily, such deck opening should be just large enough to accommodate the configuration defined by the outer leg members 40, such that when the frame member is inserted into the deck opening, the outwardly directed flange portions 46 will abut against the deck surface. Apertures 48 are provided in the flanges 46 to receive screws or bolts which fasten into the deck and hence hold the entire door unit 10 in fixed position.

A shoulder 50 extends inwardly from the upper edge of each inner leg member 42. A support rail means is formed integrally with and extends upwardly from the inner edge of the shoulder 50. This support rail means, as best illustrated in FIG. 3, is formed by a pair of upstanding ribs 52 and 54 which define between them, a continuous groove 56. The groove 56 serves to retain the lower portion 58 of an elastomeric sealing gasket. The upper portion of the sealing gasket, designated 60, is formed as a circular bead which extends slightly above the support rail means. In order to retain the sealing gasket locked in position in the groove 56, the support rail rib 54 is crimped or otherwise upset, as shown as 62.

Figure 4:
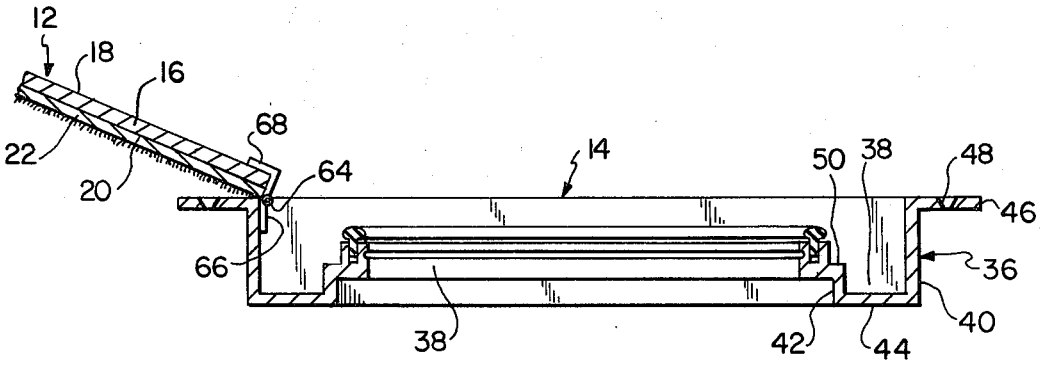
FIG. 4 is a transverse sectional view taken along the line 4—4 of FIG. 1.
Figure 5:
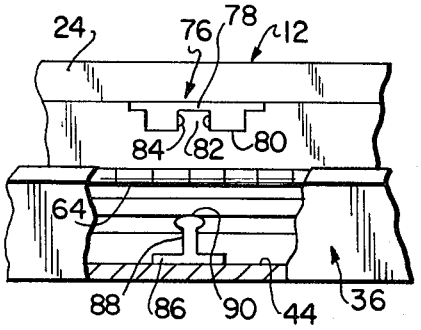
FIG. 5 is a fragmentary front elevational view, partly in section, illustrating the latch means used on the marine door unit.

The door means 12 is attached to the frame means 14 by means of a continuous piano-type hinge 64. As best illustrated in FIG. 4, the hinge 64 has a straight flange 66 which attaches to the inner surface of a frame outer ledge member 40. The other hinge flange 68 is reverse L-shaped and attaches about the edge of the door plate member 16 and to the inner surface 18 thereof.

Any suitable type of handle 70 can be used to open and close the door. Advantageously, the handle can be a ring-type which recesses flatly into the surface covering 22 when not in use but which can be pivoted outwardly and grasped to move the door from its closed position as shown in FIG. 1 to its open position as shown in FIG. 2.

To provide a means for draining any water accumulation in the channel 38, an aperture 72 is provided along the base portion 44 of one of the side frame members. A depending drain tube 74 is attached to such base member in alignment with the aperture 72 to enable water to flow through the aperture and the drain tube. The drain tube itself can be connected by a hose which leads to a drain area outside the storage area covered by the door unit.

In order to assist in keeping the door unit closed, a latch means generally designated 76 can be provided. The latch means 76 includes a first portion 78 which attaches to the inner leg 28 of the door molding. This first section includes a plate 78 which carries a pair of spaced depending sections 80 which define between them, an opening 82. Each of the sections 80 carries a spring biased ball 84 normally urged into the opening 82. The second section of the latch means is attached inside one of the side frame members 36. It includes a flat attachment portion 86 which connects with the base member 44, an upstanding portion 88 and a bulbous section 90 at the top thereof. When the door is swung to its closed position, the bulbous section 90 fits into the opening 82 and biases the balls 84 back into their chamber 80. When the door is fully closed, the balls are then urged outward into contact with the upstanding section 88 and hence are releasably locked beneath the bulbous section 90.

If attention is again directed to FIG. 3, it will be seen that when the door is swung to its closed position, the inner surface 18 of the door plate member 16 abuts against the sealing bead 60 and compresses the same against the top of the support rail means. This thus forms a continous seal between the door and the frame means so as to prevent any liquid leakage. It will further be noted that the size of the door is such that when closed, the edge molding 24 along the door means fits closely within the inner confines of the frame outer legs 40. In the event that water or other liquid flows through the small crack between the edge of the door and the inner surface of the frame means outer legs 40, such water will simply accumulate in the channel 38 and will drain out of the channel through the drain aperture 72 and drain tube 74. Finally, it will be noted that when the door is in its closed position, as illustrated in FIG. 3, the surface covering 22 is substantially coextensive with the frame flange 46 so that the entire door unit can be safely stood upon or walked across safely and without presenting any hazard.

Figure 6:
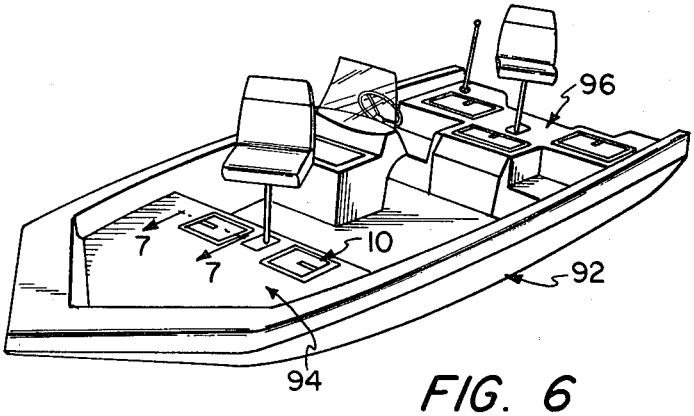
FIG. 6 is a perspective view of a representative boat on which the door means is installed at several locations along fishing platforms.
Figure 7:
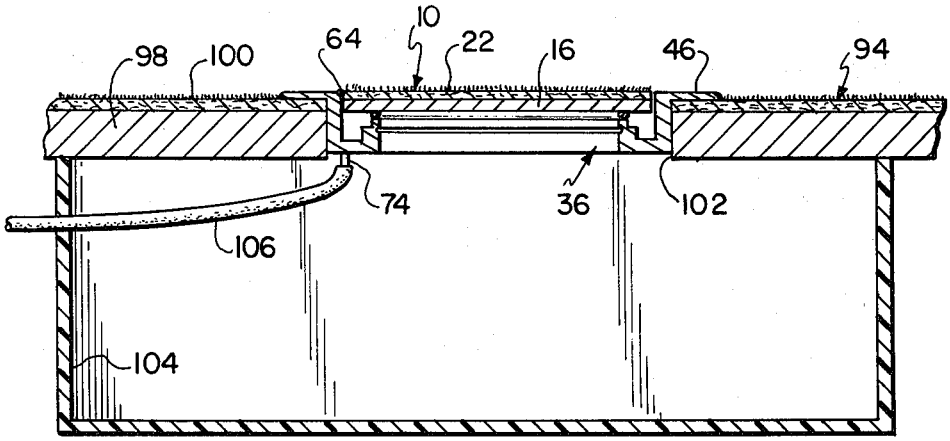
FIG. 7 is a transverse sectional view taken along the line 7—7 of FIG. 6.

Having now described the nature and operation of the door means, attention is directed to FIGS. 6 and 7 which illustrate the use of such door means on a boat. The boat, generally designated 92, is of the type which has raised forward and aft fishing platforms 94 and 96, respectively. Each of these fishing platforms includes a rigid deck 98, advantageously formed of fiberglass, and a surface covering 100, advantageously formed of slip-proof weather-resistant carpeting. An opening 102 through the deck 98 and overlying carpeting 100 provides access to a storage compartment 104 beneath the deck. The door unit 10 fits snugly into the opening 102 and the flange 46 extends outwardly to abut against the deck and covering portion peripherally surrounding the opening 102, thus suspending the door unit within the opening. In this way, the raw fiberglass or other deck material which surrounds the opening need not be trimmed. A conduit 106 leads away from the drain tube 74 to assure that the liquid collected in the channel means will not drain into the compartment 104. In this way, the compartment is kept dry by the door unit which nevertheless provides quick and easy access to the compartment while remaining substantially flush with the surrounding deck surface which forms the fishing platforms 94 and 96.

While the frame means 14 has been described as formed of four interconnected metallic side frame members, it could likewise be formed as an integral unit, such as by being injection molded of plastic. Thus, in referring to the frame means as having side frame members, it will be understood that this comprehends any frame means with sides, regardless of whether the frame is formed as an integral unit or is formed of separate interconnected members.

Various other changes or modifications apparent to those skilled in the art may be made without departing from the spirit and scope of the invention as defined in the appended claims.

What is claimed:

1. A marine door unit adapted to be inserted into an opening in the deck surface of a boat for the purpose of permitting access to a compartment beneath the deck surface while preventing water leakage into such compartment, said unit comprising:

a frame means including four interconnected side members which fit into the opening in the deck surface;

said side members having outwardly directed flanges which exceed the size of the opening in the deck surface whereby the flanges abut against the deck surface and suspend the frame means in the opening when said unit is installed in a boat;

said side members each including spaced parallel inner and outer leg portions interconnected by a base portion extending between them to thereby define an upwardly directed channel;

said four interconnected side members thus providing four interconnected channels which serve to define a continuous open-topped channel means which extends about the periphery of the opening in the deck surface;

a flat door having an inner surface which is directed toward said channel means and an outer surface which is substantially coextensive with said deck surface when said door is in its closed position;

said door being hingeably attached along one edge thereof to the top of one of said frame outer leg portions to thereby enable said door to swing completely open so that the outer surface thereof abuts against said deck surface;

support means engageable against the inner surface of said door when said door is in its closed position to thereby permit said door to support the weight of a person standing upon or walking across the closed door;

said support means including an upstanding support rail means connected with said side frame inner leg portions;

said support means further including a continuous sealing gasket which abuts and seals against said door inner surface when said door is closed; and drain means in said channel means;

said unit having a narrow crack formed between the periphery of said door and the outer leg portions of said side members when said door is in its closed position, said crack being aligned above said channel means so that water which leaks through the crack will enter directly into the channel means and will discharge therefrom through said drain means;

said sealing gasket being operative to prevent water from overflowing said channel means and entering said compartment since such water is prevented from passing between said gasket and said door inner surface so long as said door is in its closed position.

2. A marine door unit as defined in claim 1 wherein said drain means includes a drain opening formed in said base portion.

3. A marine door unit as defined in claim 1 wherein a surface covering layer is positioned upon the outer surface of said door and wherein molding means extends at least partially along the periphery of said door to retain the covering layer in position.

* * * * *